US008307480B2

(12) United States Patent
Tirpan

(10) Patent No.: US 8,307,480 B2
(45) Date of Patent: Nov. 13, 2012

(54) ENCLOSURE FOR ITEMS SUSCEPTIBLE TO INFESTATION BY CERTAIN ORGANISMS

(75) Inventor: Ani Tirpan, New Rochelle, NY (US)

(73) Assignee: London Luxury, LLC, New Rochelle, NY (US)

( * ) Notice: Subject to any disclaimer, the term of this patent is extended or adjusted under 35 U.S.C. 154(b) by 0 days.

(21) Appl. No.: 12/610,816

(22) Filed: Nov. 2, 2009

(65) Prior Publication Data

US 2010/0054637 A1 Mar. 4, 2010

Related U.S. Application Data

(63) Continuation of application No. 12/166,816, filed on Jul. 2, 2008, now abandoned.

(51) Int. Cl.
*A47C 17/00* (2006.01)

(52) U.S. Cl. ..... 5/699; 5/738; 5/939

(58) Field of Classification Search ..... 206/525, 206/810; 5/482, 490, 484, 491, 699, 738, 5/939; 383/42, 61.3
See application file for complete search history.

(56) References Cited

U.S. PATENT DOCUMENTS

| | | | | |
|---|---|---|---|---|
| 3,241,161 | A * | 3/1966 | Dashosh | 5/501 |
| 3,292,748 | A * | 12/1966 | Rifkin | 383/61.3 |
| 5,321,861 | A * | 6/1994 | Dancey et al. | 5/482 |
| 5,566,410 | A * | 10/1996 | Schaechter | 5/490 |
| 6,017,601 | A * | 1/2000 | Amsel | 428/36.1 |
| 6,363,553 | B1 * | 4/2002 | Baumgartel et al. | 5/482 |
| 6,571,432 | B1 * | 6/2003 | Rindle | 24/432 |
| 6,594,838 | B1 * | 7/2003 | Hollander et al. | 5/636 |
| 6,634,042 | B2 * | 10/2003 | Blossman | 5/499 |
| 6,948,207 | B2 * | 9/2005 | Daly | 5/738 |
| 7,249,389 | B2 * | 7/2007 | Russell | 5/502 |
| 2007/0261170 | A1 * | 11/2007 | Hollander | 5/636 |
| 2009/0083908 | A1 * | 4/2009 | Fry | 5/636 |

* cited by examiner

*Primary Examiner* — Mickey Yu
*Assistant Examiner* — Chun Cheung
(74) *Attorney, Agent, or Firm* — Cozen O'Connor

(57) ABSTRACT

An enclosure for preventing certain organisms from escaping from an item susceptible to infestation into the surrounded environment and for preventing certain organisms from entering the item susceptible to infestation from the surrounding environment. The enclosure is defined by a flexible sheet material defining an interior space. The enclosure comprises a slit-like opening formed in the flexible sheet material through which an item susceptible to infestation can be inserted into the interior space defined by the enclosure.

13 Claims, 4 Drawing Sheets

ENCLOSURE FOR ITEMS SUSCEPTIBLE TO INFESTATION BY CERTAIN ORGANISMS

FIELD OF THE INVENTION

The present invention relates generally to an enclosure and more particularly, to an enclosure for an item susceptible to infestation by certain organisms, the enclosure for preventing certain organisms from escaping from the item into the surrounding environment or entering into the item from the surrounding environment.

BACKGROUND OF THE INVENTION

Bed bug infestations have become more and more common in recent years due to increases in international travel. Individuals staying at hotels, motels or bed and breakfasts that are infested with bed bugs are likely to carry the bed bugs back to their homes in their luggage or in their clothing. These bed bugs can subsequently infest many parts of the home, particularly soft furnishings, which provide a highly suitable environment for bed bugs to multiply. It is their association with bedding, however, which brings them into the closest and most prolonged contact with humans. In infested homes, bedding items, including pillows, duvets, mattresses, and box springs have been found to house large numbers of bed bugs and their eggs.

Bed bugs are a cause of concern for humans as they feed mainly off human blood and their bites can cause symptoms such as swelling and itchiness. Infestations may take up to three months to notice and bedding items may be infested before one can take preventative action as bed bugs lay about 5 eggs per day; their numbers can proliferate quickly and bed bugs can live up to a year without feeding.

Conventional pillowcases and mattress covers are not effective to prevent bed bugs from escaping from infested bedding items and making contact with humans who are laying on the bed nor are they effective in preventing bed bugs from infesting the bedding items and laying eggs therein. Laundry bags and travel bags currently on the market are also not effective in preventing bed bugs from infesting clothing stored in the bags. These enclosures have interior spaces which are not sufficiently sealed from the surrounding environment, providing bed bugs with easy routes of travel back and forth between the interior spaces, in which the bedding or other items are situated, and the outside environment.

Bed bug infestations are very difficult to eliminate and it can be very expensive and impractical to replace bedding items infested with bed bugs. Insecticides such as DDT, which have been proven effective against bed bugs, have been banned in many countries, including the United States, and have been replaced with weaker insecticides. Many bed bugs have grown resistant to these weaker insecticides which makes infestations harder to control.

SUMMARY OF THE INVENTION

Accordingly, it is an object of the present invention to provide a new and improved enclosure for items susceptible to infestation by certain organisms to prevent organisms from traveling between the interior of the enclosure where the items are situated and the outside environment.

Another object of the present invention is to provide new and improved enclosures such as sheets, pillowcases and the like, for bedding items susceptible to infestation by certain organisms to prevent organisms from traveling between the interior of the enclosure where the bedding items are situated and the outside environment.

Still another object of the present invention to provide a method for controlling bed bug infestation without having to replace infested bedding items.

It is yet another object of the present invention to provide a method of preventing migration of bed bugs from an infested dwelling to a non-infested dwelling.

Still another object of the present invention is to prevent bed bugs from infecting an individual's clothing.

In accordance with the present invention, these and other objects are attained by providing an enclosure for items, such as bedding and clothing, which are susceptible to infestations by certain organisms, for preventing the organisms from escaping from the items into the external environment and for preventing certain organisms from infesting the items from the external environment. The enclosure is defined by flexible sheet material defining an interior space. The enclosure comprises an opening formed in the flexible sheet material through which an item susceptible to infestations by certain organisms can be inserted into the interior space defined by the enclosure. The opening is preferably slit-like and is defined by a pair of opposed free edges of the flexible sheet material, and extends between a first end and a second end. A sliding-type fastener including a slide, extends from the first end to the second end of the slit-like opening wherein, when the slide of the sliding-type fastener is positioned at the first end, the slit-like opening is open. When the slide is moved to the second end, the slit-like opening is substantially closed except for an unavoidable small opening formed between the slide and the second end of the slit-like opening. The enclosure also includes a first strip of flexible sheet material having a first edge attached to an inner surface of one of the opposed free edges of the flexible sheet material and which extends between the first and second ends of the slit-like opening and a second strip of flexible sheet material interconnecting opposing edges of the slit-like opening in the region of the second end and which is positioned between the slit-like opening and the first strip of flexible sheet material.

An assembly of bedding situated within an enclosure, for example comprising a mattress, box spring or pillow, situated within the enclosure described above is also provided.

BRIEF DESCRIPTION OF THE FIGURES

A more complete appreciation of the present invention and many of the attendant advantages thereof will be readily understood by reference to the following detailed description when taken in conjunction with the accompanying drawings, in which.

DETAILED DESCRIPTION OF THE PREFERRED EMBODIMENT

Figure 1:
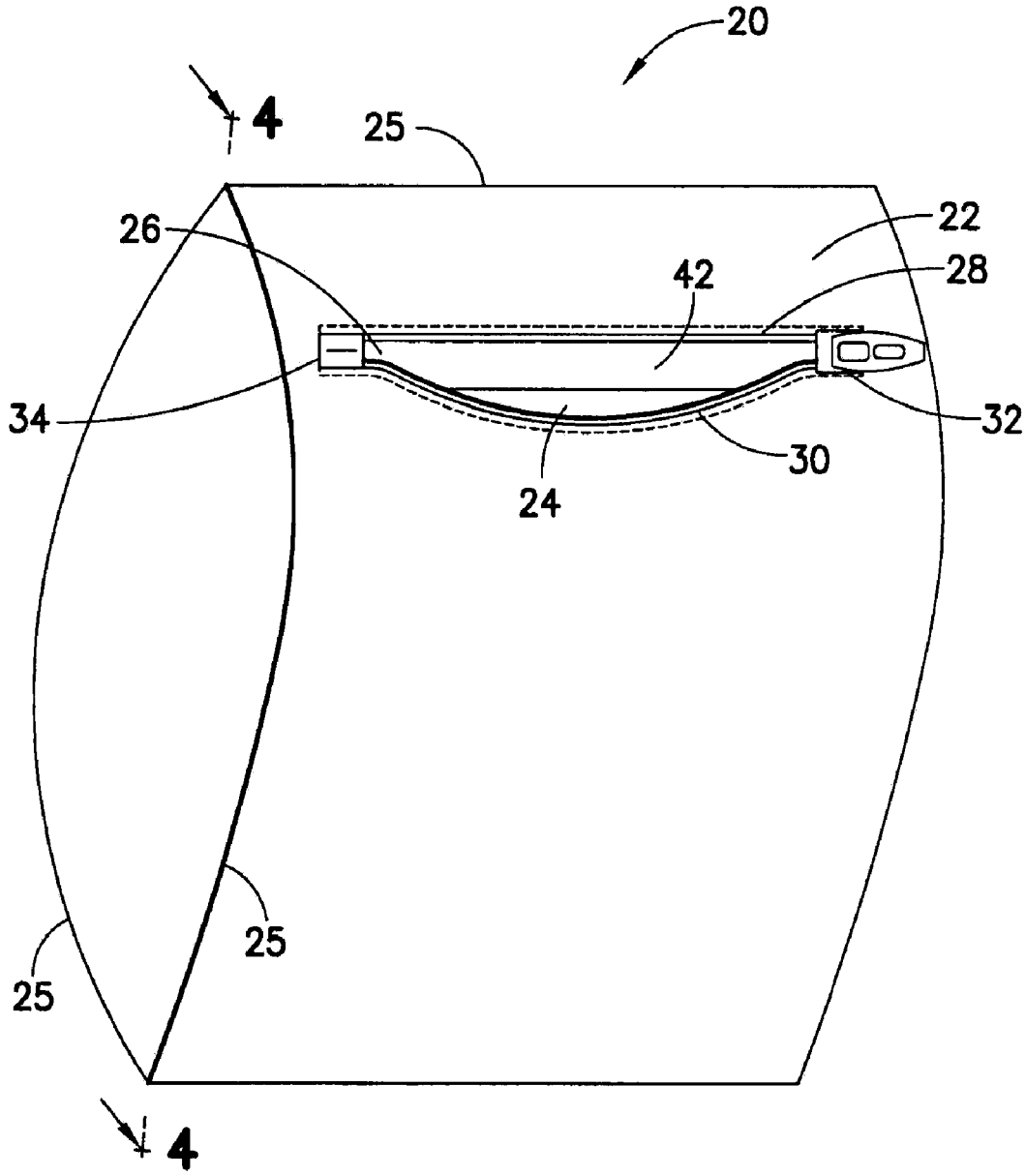
FIG. 1 is a front perspective view of an enclosure in accordance with present invention in an open position.

Referring now to the drawings, in which like reference characters designate identical or corresponding parts throughout the several views, and more particularly FIG.1, an enclosure, in the illustrated embodiment, a pillow case, generally designated 20, is illustrated for enclosing an item, such as a pillow 10, which is susceptible to infestation by certain organisms, e.g., bed bugs. According to the invention, the pillowcase 20 is structured and arranged to prevent bed bugs already resident in the pillow from escaping from the interior space within the pillowcase into the surrounding environment and for preventing bed bugs from entering into the interior space of the pillowcase from the surrounding environment. While described in the context of a pillowcase, an enclosure of the invention is generally useful for containing an item, such as a mattress, pillow, box spring, clothing, or other item which is susceptible to infestation by small organisms such as bed bugs. Pillow 10 may be substantially free of certain organisms, such as bed bugs, when placed inside pillowcase 20.

Referring to FIG. 1, the pillowcase 20 is formed of a flexible polyester sheet material 22 defining an interior space 24. The flexible sheet material may be formed of other fabrics such as fleece, satin, silk, cotton, or any other fabric such as a composite fabric composed of two or more fabrics. The fabric is preferably a fabric that is soft and non-irritating to human skin as well as hypoallergenic and waterproof. Flexible sheet material 22 is sewn together along common side margins 25 to form enclosure 20 defining a closed interior space. Side margins 25 may be sewn together through the use of reinforced seams, double stitching, bias binding on the inside seams, or any other sewing or other technique known in the art.

In accordance with the illustrated embodiment, enclosure 20 is sized to receive a standard pillow 10 within its interior space 24. It is understood that the enclosure may be of different sizes such that interior space 24 is suitable for containing other bedding items, such as a mattress or box spring of any size including, but not limited to, industry standard sizes such as full, twin, queen, or king sizes. Enclosure 20 may also be sized and shaped to receive items of clothing, towels and other articles made from fabric materials within interior space 24 and to fit within a travel bag.

A slit-like opening 26 is formed in the flexible sheet material of enclosure 20. Slit-like opening 26 is defined by a pair of opposed first and second free edges 28 and 30 of flexible sheet material 22. Slit-like opening 26 extends from a first end 32 to a second end 34. First end 32 and second end 34 may be at opposite ends of enclosure 20 as shown in FIG. 1 or may be positioned closer to each other. Slit-like opening 26 is sized and shaped to receive a pillow 10. However, in accordance with the application to which the invention is to be part, the enclosure and slit-like opening may be sized and shaped to receive a mattress, a box spring or any other item susceptible to infestation by bed bugs.

Figure 2:
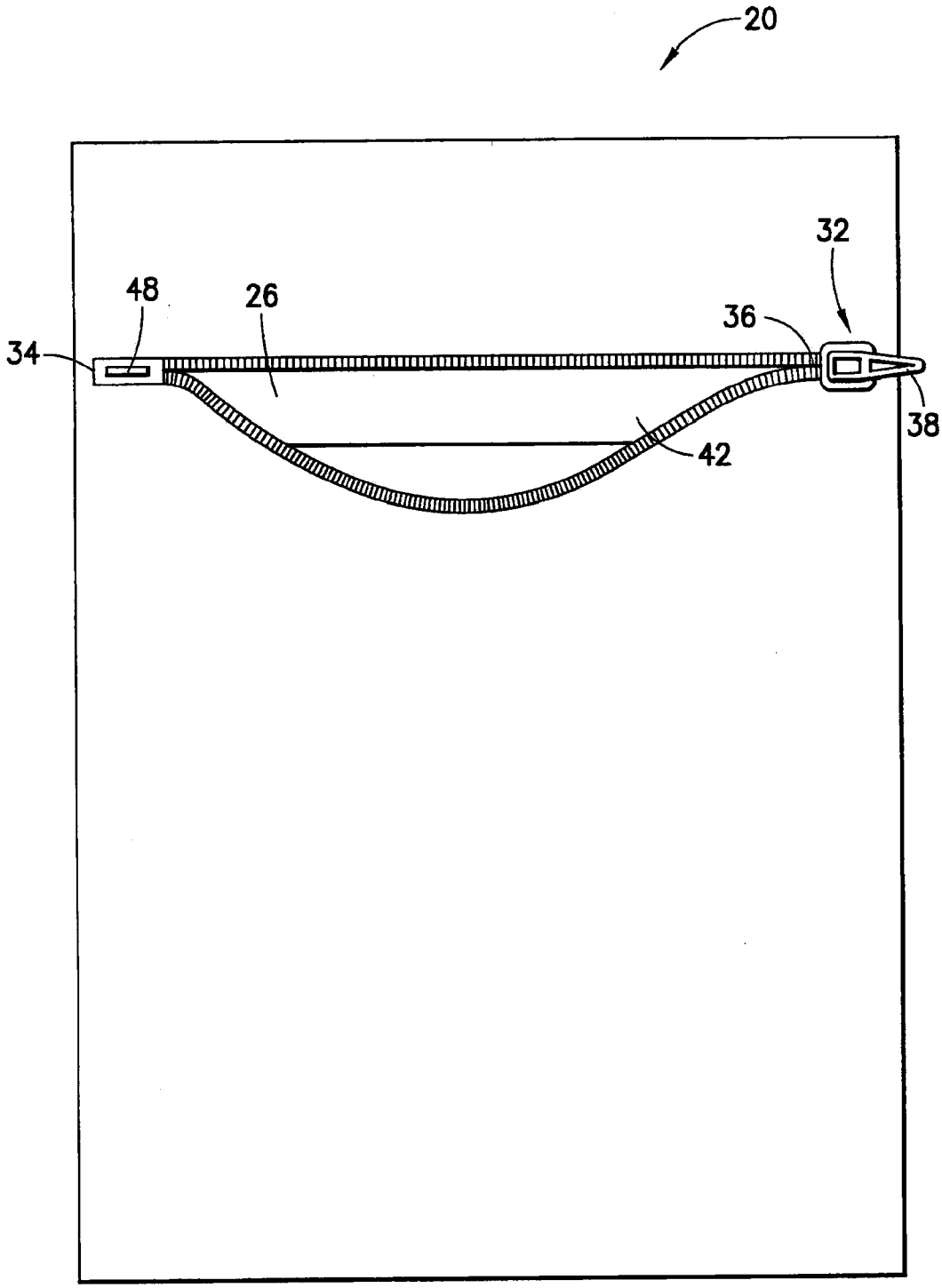
FIG. 2 is a front view of the enclosure as shown in FIG. 1.
Figure 3:
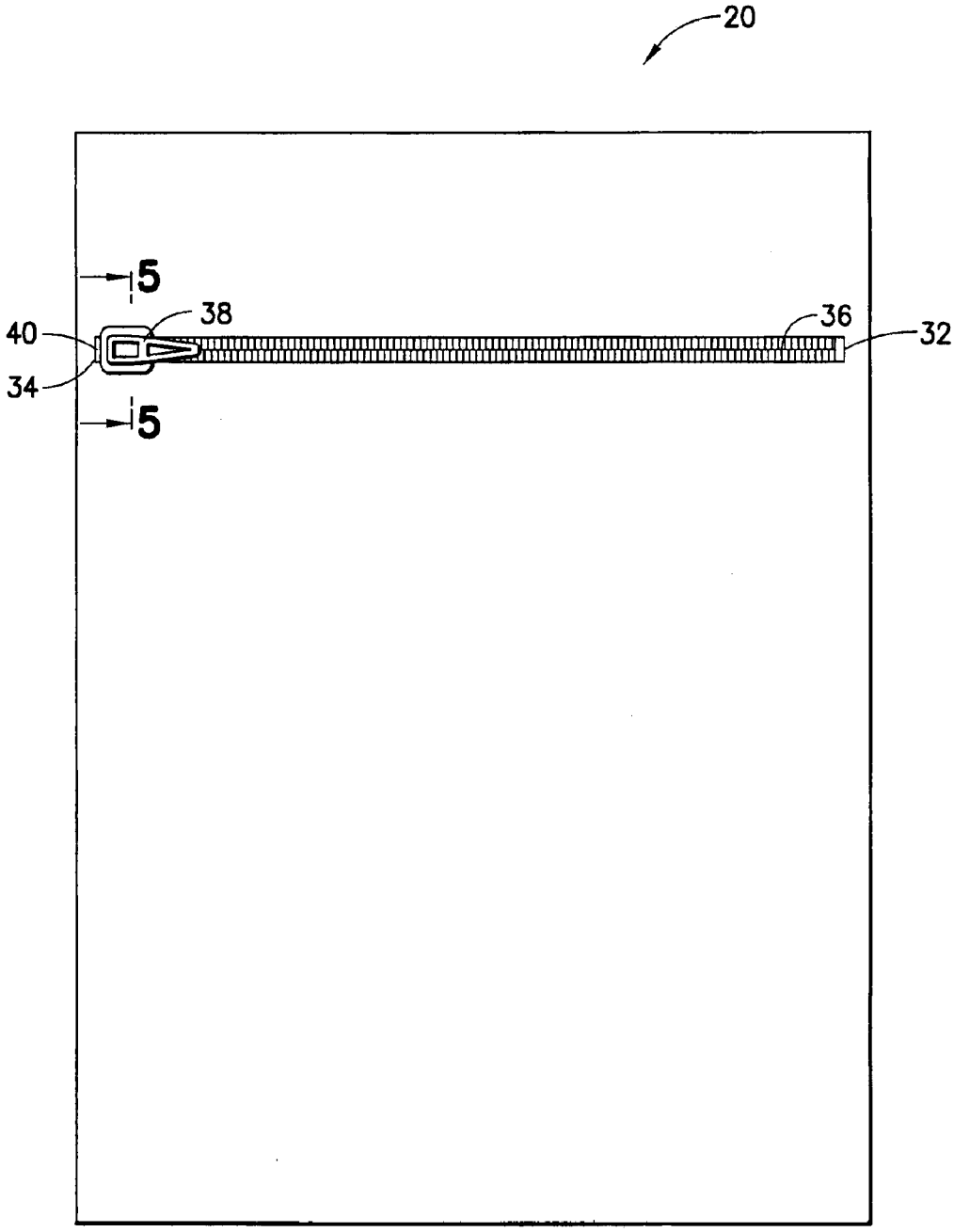
FIG. 3 is a front view of the enclosure as shown in FIG. 1 in a closed position.

Referring now to FIG. 2, a sliding-type fastener 36 such as a zipper fastener, including a slide 38, extends from a first end 32 to a second end 34 of the slit-like opening 26. When slide 38 of the sliding-type fastener 36 is positioned at first end 32 (FIG. 2), slit-like opening 26 is open and access is provided to the interior space 24 of enclosure 20. When slit-like opening 26 is open, a pillow can be situated within the interior space 24 or removed from the interior space 24. Referring now to FIG. 3, when slide 38 is positioned at second end 34 of slit-like opening 26 (FIG. 3), the opening 26 is substantially closed. However, when slide 38 is positioned at the second end 34 of opening 26, a very small space or gap 40 is present between slide 38 and second end 34 of slit-like opening 26. Space 40 is the size of a typical space found at the closed end of a zipper. While the space 40 is small, it is sufficiently large that bed bugs, or similar organisms that infest pillows, can escape from within the interior of the enclosure 20 or pass from the exterior into the interior space 24.

Figure 4:
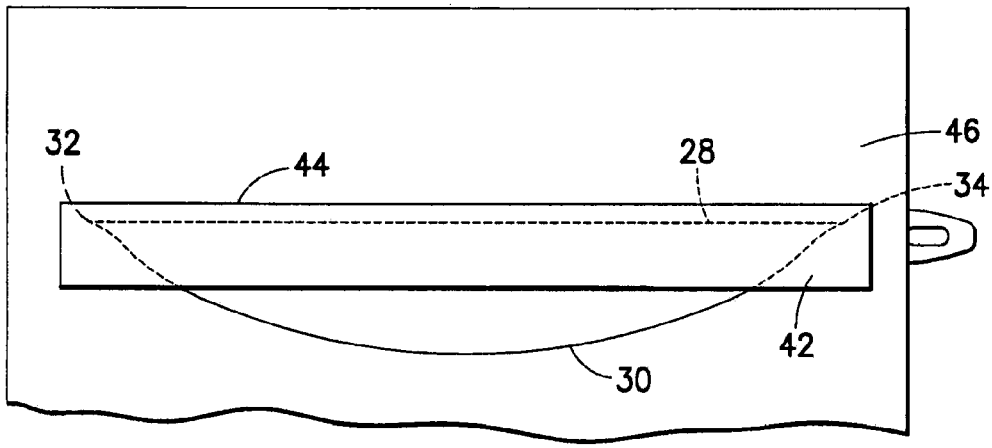
FIG. 4 is a section view of the enclosure taken along line 4-4 of FIG. 1, and showing an opposed edge of the opening of the enclosure attached to a first strip of flexible sheet material.
Figure 5:
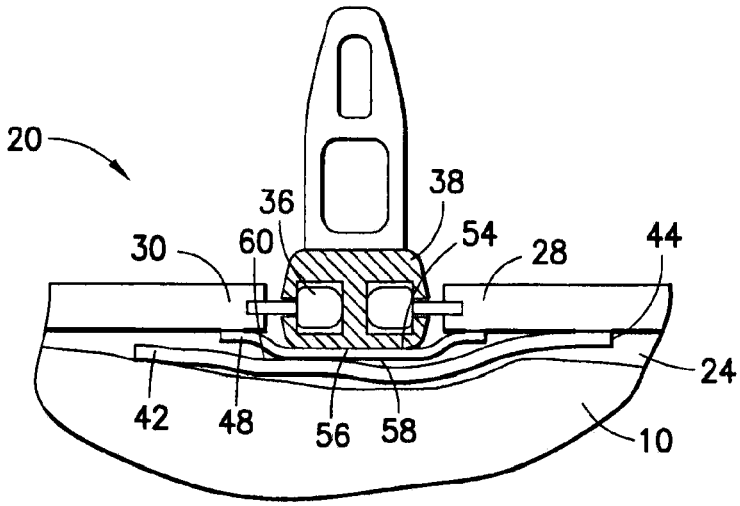
FIG. 5 is a cross-sectional view of the enclosure according to FIG. 1 taken along line 5-5 of FIG. 3, wherein the sliding-type fastener is in a closed position.

Referring now to FIG. 4, which is a section view from the interior 24 of the enclosure taken along line 4-4 of FIG. 1, a first strip 42 of flexible sheet material has a first edge 44, attached to an interior surface 46 of the entire length of the first free edge 28 of the opening 26 of enclosure 20. First edge 44 of strip 42 may be stitched, glued or attached to interior surface 46 in any manner. Alternatively, first edge 44 of the first strip of flexible sheet material 42 may be attached to the interior surface of the second free edge 30 of the opening 26 of the enclosure 20, first strip of flexible sheet material 42 extends the entire length between the first end 32 and the second end 34 of opening 26, i.e., extends over the entire length of slit-like opening 26 and into interior space 24 (FIG. 5). When a pillow is inserted into interior space 24 of enclosure 20, an inner surface of the first strip of flexible sheet material 42 will rest on the pillow.

Referring again to FIG. 2 in conjunction with FIG. 5, the ends of a second shorter strip 48 of flexible sheet material are fastened to and interconnects opposing edges 28 and 30 of the opening 26 in the region of second end 34. That is, the second strip of flexible sheet material only extends a short distance from the second end 32 of opening 34 towards first end of opening 26. Second strip 48 of flexible sheet material is situated between slit-like opening 26 and the first strip 42 of flexible sheet material. As shown in FIG. 5, when slide 38 is positioned at second end 34 of opening 26 so as to close opening 26, an outer surface 54 of second strip 48 of flexible sheet material is substantially flush with an inner surface 56 of sliding-type fastener 36. An inner surface 58 of the second strip of flexible sheet material 48 may be attached to a portion of an outer surface 60 of the first strip 42 of flexible sheet material by a releasable fastener, such as a hook and loop fastener.

The first strip 42 of flexible material functions as a barrier between the opening 26 and the pillow, preventing bed bugs from entering into the interior of the pillowcase. The second strip 48 functions to seal the small space between the slide 38 and the second end 34 of opening 26 and prevents bed bugs from entering through that space.

When the second strip 48 of flexible material is connected to the first strip 42 of flexible sheet material 42, if bed bugs are present within enclosure 20, they are unable to escape into the surrounding environment. Bed bugs outside of enclosure 20 are similarly unable to enter into interior of enclosure 20 from the surrounding environment.

Enclosure 20 may constitute enclosures for bedding items, such as pillowcases, mattress covers, and box spring covers, as well as travel enclosures such as laundry bags, travel bags and suitcase linings. However, it is understood that an enclosure in accordance with the present invention may be formed to receive any item susceptible to infestation by certain organisms.

The invention has been described with reference to an embodiment that illustrates the principles of the invention, but which is not meant to limit the scope of the invention. Modifications and alterations may occur to others upon reading and understanding the preceding detailed description. It is intended that the scope of the invention be construed as including all modifications and alterations that may occur to others upon reading and understanding the preceding detailed description insofar as they come within the scope of the following claims or equivalents thereof. Various changes may be made without departing from the spirit and scope of the invention.

I claim:

1. An enclosure assembly for items susceptible to infestation by certain organisms, the enclosure for preventing certain organisms infesting the items from escaping into the surrounding environment and for preventing certain organisms from entering the items from the surrounding environment, comprising:

an enclosure defined by a flexible sheet material defining an interior space;

a slit-like opening formed in said flexible sheet material through which an item susceptible to infestation can be inserted into the interior space defined by the enclosure;

said slit-like opening being defined by a pair of opposed free edges of said flexible sheet material, said slit-like opening extending between a first end and a second end;

a sliding type fastener including a slide, extending from said first end to said second end of said slit-like opening wherein, when the slide of said sliding-type fastener is positioned at said first end, the slit-like opening is open and when the slide is positioned at said second end, the slit-like opening is substantially closed except for a small space between said slide and said second end of said slit-like opening;

a first strip of flexible sheet material having a first edge attached to an inner surface of one of said opposed free edges of said flexible sheet material and a second edge unattached to said flexible sheet material defining said enclosure, said first strip of flexible material extending substantially over the entire length of said opening between the first and second ends of the slit-like opening; and a second strip of flexible sheet material attached to and interconnecting both of said opposing edge of regions of said opposed free edges of said flexible sheet material defining said enclosure substantially only in the region of said second end, said second strip of flexible sheet material being positioned between said slit-like opening and said first strip of flexible sheet material to overlap said small space defined between said slide positioned at said second end of said opening and said second end of said opening, and wherein an outer surface of said first strip of flexible sheet material is attached to an inner surface of said second strip of flexible sheet material by a releasable fastener.

2. The enclosure according to claim 1, wherein said releasable fastener is a hook and loop fastener.

3. The enclosure according to claim 1, wherein when said slide is positioned at said second end, an inner surface of said sliding-type fastener is substantially flush with an outer surface of said second strip of flexible sheet-like material.

4. The enclosure according to claim 1, wherein said sliding-type fastener is a zipper.

5. The enclosure according to claim 1, wherein said items susceptible to infestation are bedding items.

6. The enclosure according to claim 5, wherein said bedding items are selected from the group consisting of pillows, mattress covers, and box springs.

7. The enclosure according to claim 1, wherein said items susceptible to infestation are clothing items.

8. The enclosure according to claim 1, wherein said flexible sheet material is manufactured from a fabric selected from the group consisting of polyester, fleece, satin, silk and cotton.

9. The enclosure according to claim 8, wherein the fabric is hypoallergenic.

10. The enclosure according to claim 8, wherein the fabric is waterproof.

11. The enclosure according to claim 1, wherein said certain organisms include bed bugs.

12. A bedding item-enclosure assembly for preventing certain organisms from escaping from bedding items into the surrounding environment and for preventing certain organisms from entering the bedding items from the surrounding environment comprising:

an enclosure for bedding items defined by a flexible sheet material defining an interior space;

a slit-like opening formed in said flexible sheet material through which a bedding item can be inserted into the interior space defined by the enclosure;

said slit-like opening being defined by a pair of opposed free edges of said opening, said slit-like opening extending between a first end and a second end;

a sliding type fastener including a slide, extending from said first end to said second end of said slit-like opening wherein, when the slide of said sliding-type fastener is positioned at said first end, the slit-like opening is open and when the slide is positioned at said second end, the slit-like opening is substantially closed except for a small space between said slide and said second end of said slit-like opening;

a first strip of flexible sheet material having a first edge attached to an inner surface of one of said opposed free edges of said flexible sheet material and a second edge unattached to said flexible sheet material defining said enclosure, said first strip of flexible material extending substantially over the entire length of said opening between the first and second ends of the slit-like opening; and a second strip of flexible sheet material attached to and interconnecting both of said opposing edge regions of said opposed free edges of said flexible sheet material defining said enclosure substantially only in the region of said second end, said second strip of flexible sheet material being positioned between said slit-like opening and said first strip of flexible sheet material to overlap said small space defined between said slide positioned at said second end of said opening and said second end of said opening;

wherein an outer surface of said first strip of flexible sheet material is attached to an inner surface of said second strip of flexible sheet material by a releasable fastener and a bedding item positioned within said enclosure.

13. The enclosure assembly according to claim 12, wherein said bedding item is selected from the group consisting of a pillow, a mattress and a box spring.

* * * * *